US008861738B2

(12) United States Patent
Kim et al.

(10) Patent No.: US 8,861,738 B2
(45) Date of Patent: Oct. 14, 2014

(54) METHOD, MEDIUM, AND SYSTEM ENCODING/DECODING MULTI-CHANNEL SIGNAL

(75) Inventors: Jung-hoe Kim, Seongnam-si (KR); Eun-mi Oh, Seongnam-si (KR); Konstantin Osipov, Saint-Petersburg (RU); Ki-hyun Choo, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 35 days.

(21) Appl. No.: 13/563,808

(22) Filed: Aug. 1, 2012

(65) Prior Publication Data

US 2012/0294448 A1 Nov. 22, 2012

Related U.S. Application Data

(63) Continuation of application No. 12/107,117, filed on Apr. 22, 2008, now Pat. No. 8,254,584.

(30) Foreign Application Priority Data

Oct. 30, 2007 (KR) ..... 10-2007-0109729

(51) Int. Cl.

| | |
|---|---|
| ***H04H 20/47*** | (2008.01) |
| ***H04H 40/36*** | (2008.01) |
| ***H04H 20/88*** | (2008.01) |
| ***G10L 19/008*** | (2013.01) |

(52) U.S. Cl.

CPC ..... *H04H 40/36* (2013.01); *H04H 20/88* (2013.01); *G10L 19/008* (2013.01); *H04H 20/47* (2013.01)

USPC ..... 381/2; 381/19; 381/23

(58) Field of Classification Search

USPC ..... 381/17–23, 1, 2

See application file for complete search history.

(56) References Cited

U.S. PATENT DOCUMENTS

| | | | | |
|---|---|---|---|---|
| 6,438,525 | B1 * | 8/2002 | Park | 704/500 |
| 8,654,985 | B2 | 2/2014 | Villemoes et al. | |
| 2006/0009985 | A1 * | 1/2006 | Ko et al. | 704/500 |
| 2006/0116886 | A1 * | 6/2006 | Kim et al. | 704/503 |
| 2006/0133618 | A1 | 6/2006 | Villemoes et al. | |

(Continued)

FOREIGN PATENT DOCUMENTS

| | | |
|---|---|---|
| KR | 10-2005-0095896 | 10/2005 |
| KR | 10-2007-0051915 | 5/2007 |

OTHER PUBLICATIONS

Office Action issued in Korean Application No. 10-2007-0109729 on Dec. 5, 2013.

(Continued)

*Primary Examiner* — Cuong Q Nguyen
*Assistant Examiner* — Yosef Gebreyesus
(74) *Attorney, Agent, or Firm* — Stanzione & Kim, LLP

(57) ABSTRACT

A multi-channel signal decoding method is provided. A down-mixed signal representative of a multi-channel signal is decoded, and parameters representing characteristic relations between channels of the multi-channel signal are decoded. An additional parameter is estimated by using the decoded parameters, and the decoded down-mixed signal is up-mixed by using the decoded parameters and the estimated parameter so as to decode the multi-channel signal.

4 Claims, 7 Drawing Sheets

(56) References Cited

U.S. PATENT DOCUMENTS

| | | | | |
|---|---|---|---|---|
| 2007/0002971 | A1* | 1/2007 | Purnhagen et al. | 375/316 |
| 2007/0127729 | A1 | 6/2007 | Breebaart et al. | |
| 2007/0223709 | A1* | 9/2007 | Kim et al. | 381/23 |
| 2008/0037809 | A1* | 2/2008 | Kim | 381/300 |
| 2009/0110208 | A1* | 4/2009 | Choo et al. | 381/71.1 |
| 2009/0164227 | A1* | 6/2009 | Oh et al. | 704/500 |
| 2010/0153097 | A1* | 6/2010 | Hotho et al. | 704/201 |

OTHER PUBLICATIONS

Korean Office Action dated Jun. 2, 2014 issued in Korean Application No. 10-2007-0109729.

Korean Office Action dated Jul. 3, 2014 issued in Korean Application No. 10-2014-0026218.

* cited by examiner $a_i$ – CURRENT SYMBOL $b_j$ – PREVIOUS SYMBOL (BY TIME OR FREQUENCY)

$i,j \in [0, (N-1)]$, WHERE N IS NUMBER OF QUANTA

METHOD, MEDIUM, AND SYSTEM ENCODING/DECODING MULTI-CHANNEL SIGNAL

CROSS-REFERENCE TO RELATED APPLICATIONS

This application is a continuation application of prior application Ser. No. 12/107,117, filed on Apr. 22, 2008 now U.S. Pat. No. 8,254,584 in the United States Patent and Trademark Office, which claims priority under 35 U.S.C. §119(a) from Korean Patent Application No. 2007-109729, in the Korean Intellectual Property Office, the disclosures of which are incorporated herein in their entirety by reference.

BACKGROUND OF THE INVENTION

1. Field of the Invention

One or more embodiments of the present invention relate to a method, medium, and system encoding/decoding a multi-channel signal and, more particularly, to a method, medium, and system encoding/decoding a multi-channel signal by using stereo parameters.

2. Description of the Related Art

A parametric stereo (PS) technique down-mixes an input stereo signal so as to generate a mono-signal, extracts stereo parameters that represent side information on the stereo signal, encodes the mono-signal and the stereo parameters and transmits the encoded mono-signal and stereo parameters. The stereo parameters include an inter-channel intensity difference (IID) corresponding to a difference between intensities of at least two channel signals included in the stereo signal according to energy levels of the channel signals, an inter-channel coherence (ICC) according to a similarity of waveforms of the at least two channel signals, an inter-channel phase difference (IPD) between the at least two channel signals, and an overall phase difference (OPD) that represents how the phase difference between the at least two channel signals is distributed between two channels on the basis of a mono-signal.

SUMMARY OF THE INVENTION

One or more embodiments of the present invention provide a multi-channel signal decoding method and apparatus for efficiently decoding stereo parameters of a multi-channel signal transmitted at a low bit rate to improve the quality of the multi-channel signal, and a computer readable recording medium storing a program for executing the multi-channel signal decoding method.

One or more embodiments of the present invention also provide a multi-channel signal encoding method and apparatus for efficiently transmitting stereo parameters that represent side information of a multi-channel signal at a low bit rate, and a computer readable recording medium storing a program for executing the multi-channel encoding method.

Additional aspects and/or advantages will be set forth in part in the description which follows and, in part, will be apparent from the description, or may be learned by practice of the invention.

According to an aspect of the present invention, there is provided a method of decoding a multi-channel signal comprising: decoding a down-mixed signal representative of a multi-channel signal; decoding parameters that represent characteristic relations between channels of the multi-channel signal; estimating an additional parameter by using the decoded parameters; and up-mixing the down-mixed signal by using the decoded parameters and the estimated parameter so as to decode the multi-channel signal.

According to another aspect of the present invention, there is provided a computer readable recording medium storing a program for executing a method of decoding a multi-channel signal comprising: decoding a down-mixed signal representative of a multi-channel signal; decoding parameters that represent characteristic relations between channels of the multi-channel signal; estimating an additional parameter by using the decoded parameters; and up-mixing the down-mixed signal by using the decoded parameters and the estimated parameter so as to decode the multi-channel signal.

According to another aspect of the present invention, there is provided a method of decoding a multi-channel signal comprising: decoding information on a domain in which a down-mixed signal representative of a multi-channel signal is encoded; decoding the down-mixed signal in a time domain or a frequency domain according to the decoded information; decoding parameters that represent characteristic relations between channels of the multi-channel signal; and up-mixing the decoded down-mixed signal by using the decoded parameters so as to decode the multi-channel signal.

According to another aspect of the present invention, there is provided a method of encoding a multi-channel signal comprising: encoding a signal obtained by down-mixing a multi-channel signal; extracting parameters that represent characteristic relations between channels of the multi-channel signal from the multi-channel signal; encoding some of the extracted parameters other than a parameter that can be estimated from the some of the extracted parameters; and outputting the encoded down-mixed signal and the encoded parameters as a multi-channel signal encoding result.

According to another aspect of the present invention, there is provided a multi-channel signal decoding system comprising: a down-mixed signal decoder to decode a down-mixed signal representative of a multi-channel signal; a parameter decoder to decode parameters that represent characteristic relations between channels of the multi-channel signal; an overall phase difference (OPD) estimator to estimate OPD that represents a phase difference between the decoded down-mixed signal and the multi-channel signal by using the decoded parameters; and an up-mixing unit to up-mix the decoded down-mixed signal by using the decoded parameters and the estimated OPD.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF THE PREFERRED EMBODIMENTS

Figure 1:
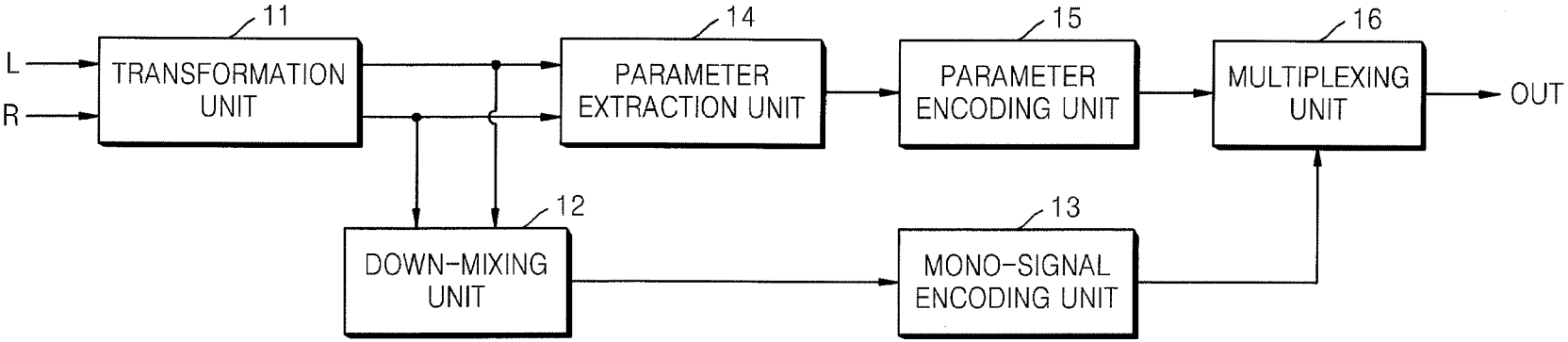
FIG. 1 is a block diagram of a multi-channel signal encoding system according to an embodiment of the present invention.

Reference will now be made in detail to embodiments, examples of which are illustrated in the accompanying drawings, wherein like reference numerals refer to the like elements throughout. In this regard, embodiments of the present invention may be embodied in many difference forms and should not be construed as being limited to embodiments set forth herein. Accordingly, embodiments are merely described below, by referring to the figures, to explain aspects of the present invention.

FIG. 1 is a block diagram of a multi-channel signal encoding system according to an embodiment of the present invention.

Referring to FIG. 1, the multi-channel signal encoding system may include a transformation unit 11, a down-mixing unit 12, a mono-signal encoding unit 13, a parameter extraction unit 14, a parameter encoding unit 15 and a multiplexing unit 16. In the current embodiment of the present invention, a multi-channel signal includes signals of multiple channels.

It is assumed that a multi-channel signal input to the multi-channel signal encoding system illustrated in FIG. 1 is a stereo signal including a left-channel signal L and a right-channel signal R. However, it will be understood by those of ordinary skill in the art that the multi-channel signal is not limited to the stereo signal.

The transformation unit 11 transforms the left-channel signal L and the right-channel signal R from the time domain into a predetermined domain through an analysis filter bank. The predetermined domain can be a domain capable of representing both the magnitude and phase of a signal. For example, the predetermined domain can be a domain that represents a signal for each of sub-bands split by a predetermined frequency.

The down-mixing unit 12 down-mixes the left-channel signal L and the right-channel signal R transformed by the transformation unit 11 and outputs a mono-signal. Here, down-mixing generates a mono-signal of a single channel from a stereo signal of at least two channels and the number of bits allocated to an encoding operation can be reduced through down-mixing. The mono-signal can be a signal representative of the stereo signal. That is, only the down-mixed mono-signal can be encoded and transmitted without respectively encoding the left-channel signal L and the right-channel signal R included in the stereo signal. Down-mixing normalizes the sum of the left-channel signal L and the right-channel signal R to generate the mono-signal in order to preserve the energy of the stereo signal.

The mono-signal encoding unit 13 encodes the down-mixed mono-signal. The mono-signal encoding unit 13 can encode the mono-signal by using different methods according to whether the input stereo signal is a speech signal or a music signal. The configuration of the mono-signal encoding unit 13 according to the type of the input stereo signal will now be explained.

In the current embodiment of the present invention, the mono-signal encoding unit 13 can include an inverse transformer and an encoder when the input stereo signal is a speech signal. The inverse transformer inversely transforms the down-mixed mono-signal into the time domain and the encoder encodes the inversely transformed mono-signal in the time domain. For example, the encoder can encode the inversely transformed mono-signal according to a code excited linear prediction (CELP) method. Here, the CELP method encodes an input signal in the time domain by using linear prediction and long-term prediction.

In another embodiment of the present invention, the mono-signal encoding unit 13 can include an inverse transformer and an encoder when the input stereo signal is a music signal. The inverse transformer inversely transforms the down-mixed mono-signal into the time domain. The encoder encodes the inversely transformed mono-signal in the time domain or transforms the inversely transformed mono-signal into the frequency domain and then encodes the mono-signal in the frequency domain.

In another embodiment of the present invention, the mono-signal encoding unit 13 can encode the mono-signal down-mixed by the down-mixing unit 12 in the frequency domain when the input stereo signal is a music signal.

In another embodiment of the present invention, a method of encoding a signal on the time axis, such as CELP method, or a method of encoding a signal on the frequency axis by using modified discrete cosine transform (MDCT)/fast Fourier transform (FFT), such as transform coded excitation (TCX) method, can be used to encode the mono-signal according to characteristics of the input signal.

The parameter extraction unit 14 extracts stereo parameters representing characteristic relations between the left-channel signal L and the right-channel signal R, which are transformed by the transformation unit 11. Specifically, the parameter extraction unit 14 can extract IID, ICC, IPD and OPD with respect to the left-channel signal L and the right-channel signal R.

A conventional stereo signal encoding system extracts only IID and ICC from among stereo parameters and encodes only the extracted IID and ICC so as to reduce the number of bits allocated to a stereo parameter encoding operation. However, the parameter extraction unit 14 of the encoding system according to the current embodiment of the present invention extracts parameters representing phase information on signals, such as IPD and OPD, as well as IID and ICC. When a signal is decoded using the parameters representing phase information in addition to IID and ICC, the quality of the signal can be improved. The detailed operation of the parameter extraction unit 14 will be explained with reference to FIG. 2.

The parameter encoding unit 15 quantizes the stereo parameters extracted by the parameter extraction unit 14 and encodes the quantization result. Specifically, the parameter encoding unit 15 quantizes only the IID, ICC and IPD from among the stereo parameters extracted by the parameter extraction unit 14 and encodes only the quantized IID, ICC and IDP in order to reduce the number of bits allocated to the stereo parameter encoding operation. In other words, the parameter encoding unit 15 does not encode the OPD extracted by the parameter extraction unit 14 or transmit the OPD to a decoding stage, and thus the number of bits allocated to the stereo parameter encoding operation can be reduced.

As described above, some of the extracted stereo parameters are transmitted from an encoding stage in order to transmit the stereo parameters at a low bit rate. However, the decoding stage is required to up-mix a signal by using all the extracted stereo parameters in order to output a stereo signal with improved quality. Accordingly, the decoding stage has to estimate a stereo parameter that is not transmitted from the encoding stage by using the stereo parameters transmitted from the encoding stage.

According to the current embodiment of the present invention, the decoding stage can estimate OPD representing a phase difference between the mono-signal and the stereo signal on the basis of IID and IPD because IID represents an inter-channel intensity difference of the stereo signal and IPD represents a inter-channel phase difference of the stereo signal. As described above, the mono-signal can be a signal representative of the stereo signal, and thus the phase difference between the mono-signal and the stereo signal can be estimated using IID and IPD. This will be explained in detail with reference to FIG. 5.

Specifically, the parameter encoding unit 15 performs arithmetic encoding on the quantization parameters. Arithmetic encoding is one of a number of entropy encoding methods that represent respective symbols or continuous symbols as a code with an appropriate length according to frequency in statistical generation of data symbols. The detailed encoding operation of the parameter encoding unit 15 will be explained with reference to FIGS. 4A and 4B.

The multiplexing unit 16 multiplexes the encoded mono-signal and the encoded parameters respectively output from the mono-signal encoding unit 13 and the parameter encoding unit 15 and outputs bit streams.

Figure 2:
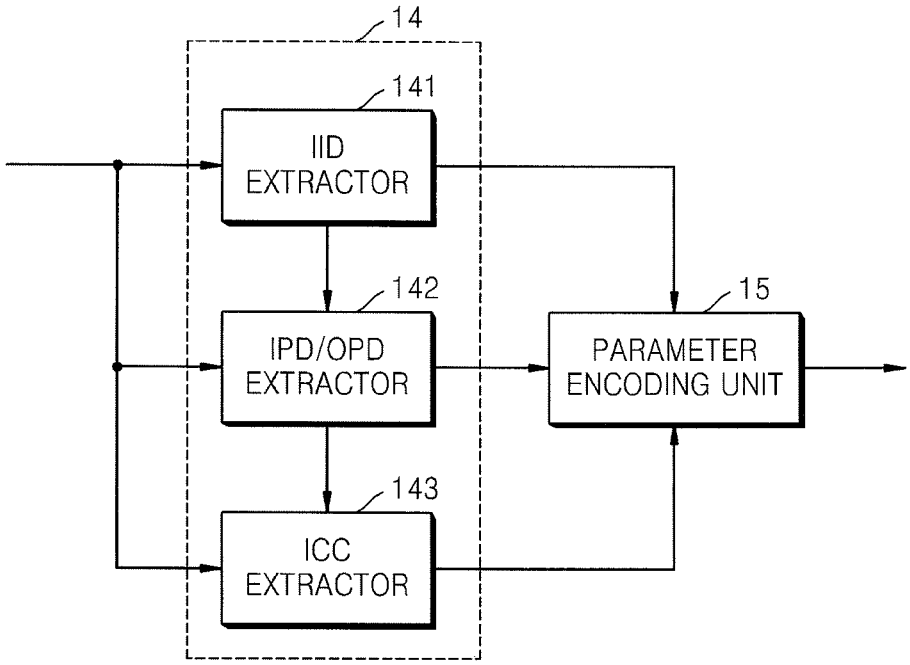
FIG. 2 is a block diagram of a parameter extraction unit included in the multi-channel signal encoding system illustrated in FIG. 1.

FIG. 2 is a block diagram of the parameter extraction unit 14 included in the multi-channel signal encoding system illustrated in FIG. 1.

Referring to FIG. 2, the parameter extraction unit 14 may include an IID extractor 141, an IPD/OPD extractor 142, and an ICC extractor 143. The parameter extraction unit 14 receives the left-channel signal and the right-channel signal transformed by the transformation unit 11 illustrated in FIG. 1.

The IID extractor 141 extracts IID that represents an intensity difference between the transformed left-channel signal and right-channel signal and outputs the extracted IID to the parameter encoding unit 15 illustrated in FIG. 1. The IID extractor 141 can extract the IID by using Equation 1.

$$IID(b) = 10\log_{10}\frac{e_L(b)}{e_R(b)} \quad \text{[Equation 1]}$$

Here, b represents a frequency band index, $e_L(b)$ denotes an average energy level of the left-channel signal in a specific frequency band of the frequency domain, and $e_R(b)$ represents an average energy level of the right-channel signal in the specific frequency band of the frequency domain. Accordingly, IID can be obtained by using a ratio of the energy level of the right-channel signal to the energy level of the left-channel signal in the frequency domain.

The IPD/OPD extractor 142 extracts IPD that represents a phase difference between the transformed left-channel signal and right-channel signal and OPD that represents how the phase difference is distributed between the left-channel signal and the right-channel signal and outputs the extracted IPD to the parameter encoding unit 15 illustrated in FIG. 1.

Figure 3:
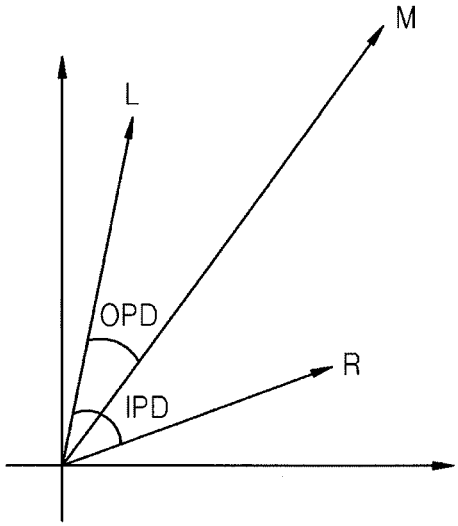
FIG. 3 illustrates a method of extracting an inter-channel phase difference (IPD) and an overall phase difference (OPD) using an IPD/OPD extractor included in the parameter extraction unit illustrated in FIG. 2.

FIG. 3 illustrates a method of extracting IPD and OPD by using the IPD/OPD extractor 142 illustrated in FIG. 2. The operation of the IPD/OPD extractor 142 is described with reference to FIGS. 2 and 3.

In FIG. 3, L denotes the left-channel signal in the frequency domain, R represents the right-channel signal in the frequency domain, and M denotes the down-mixed mono-signal. Here, IPD and OPD can be respectively obtained using Equations 2 and 3.

$$IPD=\angle(L\cdot R) \quad \text{[Equation 2]}$$

Here, L·R denotes a dot product of the left-channel signal L and the right-channel signal R and IPD represents an angle made by the left-channel signal L and the right-channel signal R.

$$OPD=\angle(L\cdot M) \quad \text{[Equation 3]}$$

Here, L·M denotes a dot product of the left-channel signal L and the down-mixed mono-signal M and OPD represents an angle made by the left-channel signal L and the down-mixed mono-signal M.

Referring back to FIG. 2, the ICC extractor 143 extracts ICC that is a parameter representing coherence of the transformed left-channel signal and right-channel signal and outputs the extracted ICC to the parameter encoding unit 15 illustrated in FIG. 1.

Figure 4A:
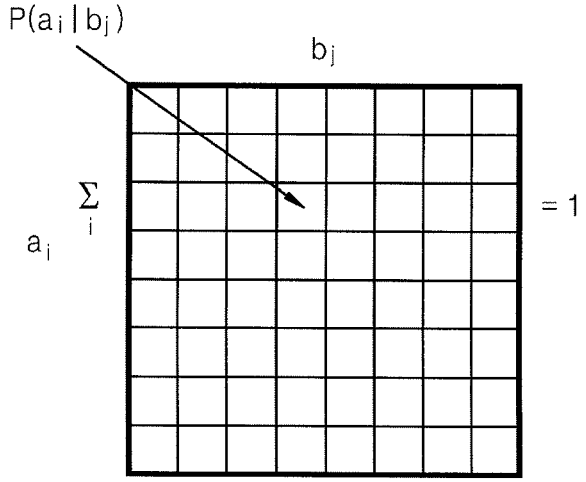
FIGS. 4A and 4B illustrate an encoding operation of a parameter encoder included in the multi-channel signal encoding system illustrated in FIG. 1.
Figure 4B:
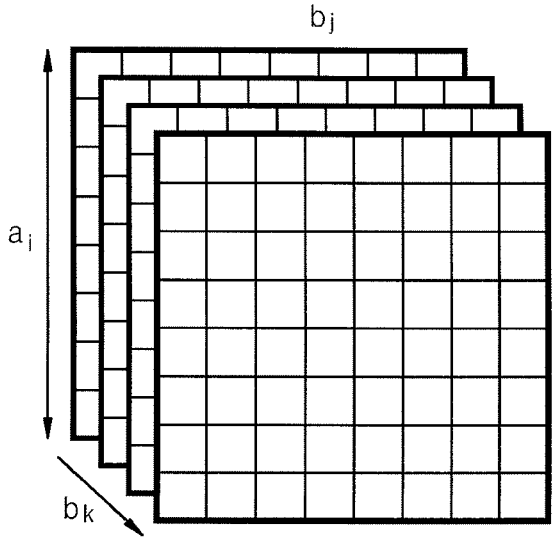

FIGS. 4A and 4B illustrate the encoding operation of the parameter encoding unit 15 included in the multi-channel signal encoding system illustrated in FIG. 1. The encoding operation of the parameter encoding unit 15 is described with reference to FIGS. 1, 4A and 4B.

In a conventional arithmetic encoding method, a symbol that is a quantized value in a current frame is encoded by obtaining a difference between a symbol of a current frame and a symbol of a previous frame or previous frequency band and encoding the difference.

FIG. 4A illustrates a context based arithmetic encoding method.

According to the arithmetic encoding method, the probability that a symbol is output from a current frame is determined according to a symbol in a previous frame or a previous frequency band on the basis of a context of frames or frequency bands. In FIG. 4A, ai denotes a current symbol, $b_j$ represents a previous symbol, and i and j correspond to 0 to N−1 (N is the number of quanta). Accordingly, the probability that a symbol is output from the current frame can be represented as $P(a_i|b_j)$ using $a_i$ and $b_j$. For example, a block indicated by an arrow in FIG. 4A represents a probability value $P(a_2|b_3)$ when i is 2 and j is 3.

In an arithmetic encoding method according to another embodiment of the present invention, the probability that a symbol is output from a current frame is determined by a symbol of a previous frame or previous frequency band and a predetermined variable f on the basis of a context of frames or frequency bands. Accordingly, the probability that a symbol is output from the current frame can be represented as $P(a_i|b_j, f_i)$ using $a_i$, $b_j$ and f.

The predetermined variable f represents whether two arbitrary symbols from among current symbols continuously increase or decrease. Specifically, when a variation in each of the two arbitrary symbols is $\Delta(\Delta_{i-1}=a_i-a_{i-1})$, the variation Δ has a positive value when the two arbitrary symbols increase and has a negative value when the two arbitrary symbols decrease.

Accordingly, the product of the variations in the two arbitrary symbols has a positive value when the two symbols continuously increase and has a positive value when the two symbols continuously decrease (that is, $\Delta_{i-1}\cdot\Delta_{i-2}>0$). However, the product of the variations has a negative value when the two symbols do not continuously increase or decrease (that is, $\Delta_{i-1}\cdot\Delta_{i-2}<0$). The variable f is 1 when the two symbols continuously increase or decrease, that is, when the product of the variations has a positive value, and 0 when the product of the variations has a negative value. That is, the probability that a symbol is output from the current frame when two arbitrary symbols of current symbols continuously increase or decrease is higher than the probability that a symbol is output from the current frame when the two arbitrary symbols do not continuously increase or decrease.

FIG. 4B illustrates a context based arithmetic encoding method according to another embodiment of the present invention. According to the arithmetic encoding method, the probability that a symbol is output from a current frame is determined by a plurality of symbols in a previous frame or previous frequency band and a predetermined variable f on the basis of a context of frames or frequency bands. In FIG. 4B, $a_i$ denotes a current symbol, $b_j$ and $b_k$ represent previous symbols in a predetermined frame or predetermined frequency band, and i, j and k correspond to 0 to N−1 (N is the number of quanta). Accordingly, the probability that a symbol is output from the current frame can be represented as $P(a_i|b_j, b_k, f_i)$ using $a_i$, $b_j$, $b_k$ and f. The variable f has been described above already and thus an explanation thereof will be omitted here.

As described above, the arithmetic encoding method illustrated in FIG. 4B increases the number of predetermined frames or predetermined bands generating previous symbols compared to the arithmetic encoding method illustrated in FIG. 4A. Accordingly, the number of symbols in previous frames or previous frequency bands, which is the basis of context-based arithmetic encoding, is increased, and thus the probability that a symbol is output from the current frame can be more accurately ascertained.

Figure 5:
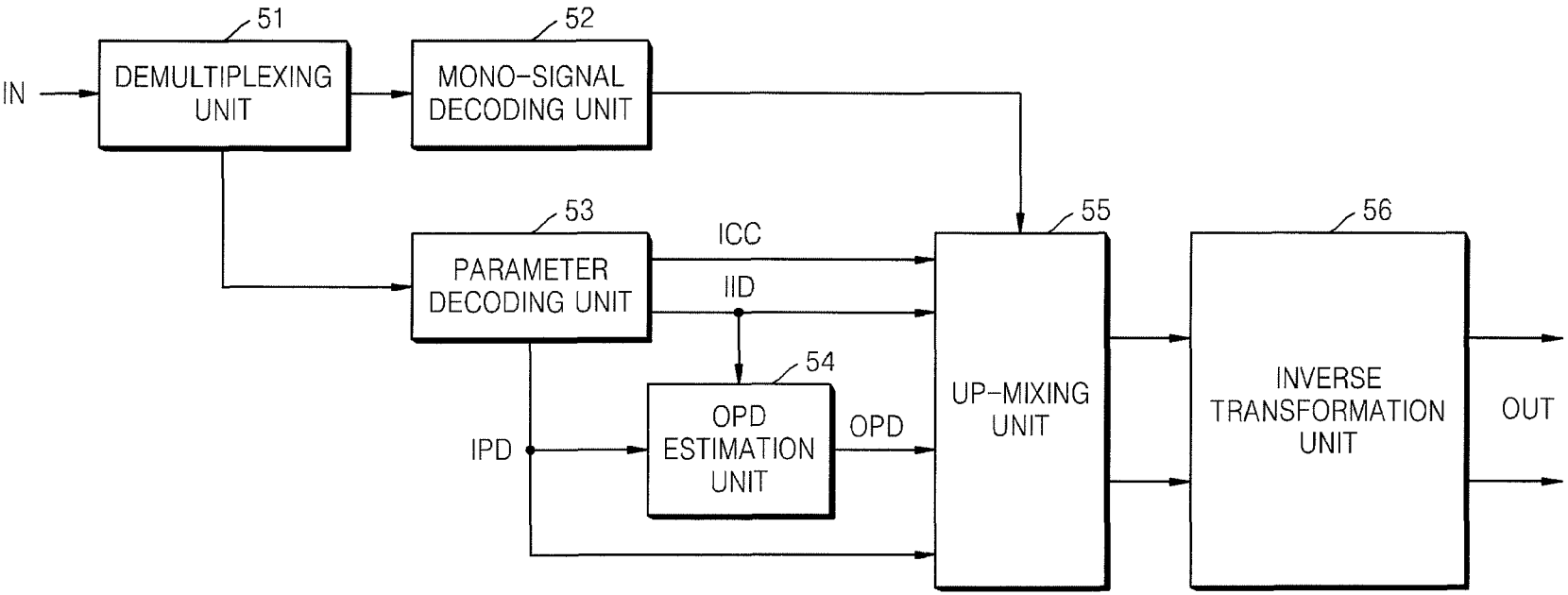
FIG. 5 is a block diagram of a multi-channel signal decoding system according to an embodiment of the present invention.

FIG. 5 is a block diagram of a multi-channel signal decoding system according to an embodiment of the present invention.

Referring to FIG. 5, the multi-channel signal decoding system may include a demultiplexing unit 51, a mono-signal decoding unit 52, a parameter decoding unit 53, an OPD estimation unit 54, an up-mixing unit 55 and an inverse transformation unit 56.

The demultiplexing unit 51 demultiplexes bit streams corresponding to an encoded multi-channel signal and outputs an encoded mono-signal and encoded stereo parameters.

The mono-signal decoding unit 52 decodes the encoded mono-signal demultiplexed by the demultiplexing unit 51. Specifically, the mono-signal decoding unit 52 decodes the encoded mono-signal in the time domain when the mono-signal is encoded in the time domain and decodes the encoded mono-signal in the frequency domain when the mono-signal is encoded in the frequency domain.

The parameter decoding unit 53 decodes the encoded stereo parameters demultiplexed by the demultiplexer 51. The encoded stereo parameters can include encoded IID, IPD and ICC. Accordingly, the parameter decoding unit 53 decodes the encoded IID, IPD and ICC and outputs IID, IPD and ICC.

The OPD estimation unit 54 estimates OPD that represents a phase difference between the decoded mono-signal and a multi-channel signal by using the decoded IPD and IID. As described above, since OPD is not transmitted from an encoding system, the decoding system is required to estimate OPD by using parameters other than OPD, transmitted from the encoding system, in order to improve the quality of a decoded stereo signal. Accordingly, the decoding system can up-mix the mono-signal by using the parameters transmitted from the encoding system and OPD estimated on the basis of the parameters so as to improve the quality of the up-mixed signal.

The operation of the OPD estimation unit 54 will now be described with reference to Equations 4 through 12.

The OPD estimation unit 54 obtains a first intermediate variable c by using IID according to Equation 4.

$$c(b) = 10^{\frac{IID(b)}{20}} \quad \text{[Equation 4]}$$

Here, b denotes a frequency band index. The first intermediate variable c can be obtained by representing the result, obtained by dividing IID in a specific frequency band by 20, as an exponent of 10. A second intermediate variable $c_1$ and a third intermediate variable $c_2$ can be obtained using the first intermediate variable c according to Equations 5 and 6.

$$c_1(b) = \frac{\sqrt{2}}{\sqrt{1 + c^2(b)}} \quad \text{[Equation 5]}$$

$$c_2(b) = \frac{\sqrt{2}\, c(b)}{\sqrt{1 + c^2(b)}} \quad \text{[Equation 6]}$$

Here, b denotes a frequency band index, and the third intermediate variable $c_2$ can be obtained by multiplying the second intermediate variable $c_1$ by c(b).

Then, the OPD estimation unit 54 can represent a first right-channel signal $\hat{R}_{n,k}$ and a first left-channel signal $\hat{L}_{n,k}$ by using a decoded mono-signal M and the second and third intermediate variables $c_1$ and $c_2$ according to Equations 7 and 8.

$$\hat{R}_{n,k} = c_1 M_{n,k} \quad \text{[Equation 7]}$$

Here, n denotes a time slot index and k represents a parameter band index. The first right-channel signal $\hat{R}_{n,k}$ can be represented by a product of the second intermediate variable $c_1$ and the decoded mono-signal M.

$$\hat{L}_{n,k} = c_2 M_{n,k} \quad \text{[Equation 8]}$$

Here, n denotes the time slot index and k represents the parameter band index. The first left-channel signal $\hat{L}_{n,k}$ can be represented by a product of the third intermediate variable $c_2$ and the decoded mono-signal M.

When IPD is $\phi$, a first mono-signal $\hat{M}_{n,k}$ can be represented using the first right-channel signal $\hat{R}_{n,k}$ and the first left-channel signal $\hat{L}_{n,k}$ as follows.

$$|\hat{M}_{n,k}| = \sqrt{|\hat{L}_{n,k}|^2 + |\hat{R}_{n,k}|^2 - 2|\hat{L}_{n,k}||\hat{R}_{n,k}|\cos(\pi - \phi)} \quad \text{[Equation 9]}$$

A fourth intermediate variable p according to a time slot and a parameter band can be obtained using Equations 7, 8 and 9 according to Equation 10.

$$p_{n,k} = \frac{|\hat{L}_{n,k}| + |\hat{R}_{n,k}| + |\hat{M}_{n,k}|}{2} \quad \text{[Equation 10]}$$

The fourth intermediate variable p corresponds to a value obtained by dividing the sum of the magnitudes of the first left-channel signal $\hat{L}_{n,k}$, the first right-channel signal $\hat{R}_{n,k}$ and the first mono-signal $\hat{M}_{n,k}$ by 2. When OPD is $\phi_1$, OPD can be obtained using Equation 11.

$$\varphi_1 = 2\arctan\left(\sqrt{\frac{(p_{n,k} - |\hat{L}_{n,k}|)(p_{n,k} - |\hat{M}_{n,k}|)}{p_{n,k}(p_{n,k} - |\hat{R}_{n,k}|)}}\right) \quad \text{[Equation 11]}$$

When a difference between OPD and IPD is $\phi_2$, $\phi_2$ can be obtained using Equation 12.

$$\varphi_2 = 2\arctan\left(\sqrt{\frac{(p_{n,k} - |\hat{R}_{n,k}|)(p_{n,k} - |\hat{M}_{n,k}|)}{p_{n,k}(p_{n,k} - |\hat{L}_{n,k}|)}}\right) \quad \text{[Equation 12]}$$

$\phi_1$, is obtained using Equation 11, is a phase difference between the decoded mono-signal and a left-channel signal to be up-mixed and $\phi_2$, which is obtained using Equation 12, is a phase difference between the decoded mono-signal and a right-channel signal to be up-mixed.

As described above, the OPD estimation unit 54 can generate the first left-channel signal and the first right-channel signal with respect to a left-channel signal and a right-channel signal from the decoded mono-signal by using IID of the multi-channel signal, generate the first mono-signal from the first left-channel signal and the first right-channel signal by using IPD of the multi-channel signal, and estimate OPD between the decoded mono-signal and the multi-channel signal using the first left-channel signal, the first right-channel signal and the first mono-signal.

The up-mixing unit 55 up-mixes the decoded mono-signal by using ICC, IID and IPD decoded by the parameter decoding unit 53 and OPD estimated by the OPD estimation unit 54. Here, up-mixing generates a stereo signal of at least two channels from a mono-signal of a single channel and is the inverse of down-mixing. The up-mixing operation of the up-mixing unit 55 will now be explained in detail.

The up-mixing unit 55 can obtain a first phase $\alpha+\beta$ and a second phase $\alpha-\beta$ by using the second and third intermediate variables $c_1$ and $c_2$ when IIC is $\rho$ according to Equations 13 and 14.

$$\alpha + \beta = \frac{1}{2}\arccos\rho\cdot\left(1 + \frac{c_1 - c_2}{\sqrt{2}}\right) \quad \text{[Equation 13]}$$

$$\alpha - \beta = \frac{1}{2}\arccos\rho\cdot\left(1 - \frac{c_1 - c_2}{\sqrt{2}}\right) \quad \text{[Equation 14]}$$

Then, the up-mixing unit 55 can obtain up-mixed left-channel and right-channel signals by using the first and second phases $\alpha+\beta$ and $\alpha-\beta$, which are obtained using Equations 13 and 14, the second and third intermediate variables $c_1$ and $c_2$, $\phi_1$, which is obtained using Equation 11, and $\phi_2$, which is obtained using Equation 12, when the decoded mono-signal is M and a decorrelated signal is D, as illustrated below.

$$L' = (M\cdot\cos(\alpha+\beta) + D\cdot\sin(\alpha+\beta))\cdot\exp(j\phi_1)\cdot c_2 \quad \text{[Equation 15]}$$

$$R' = (M\cdot\cos(\alpha-\beta) - D\cdot\sin(\alpha-\beta))\cdot\exp(j\phi_2)\cdot c_1 \quad \text{[Equation 16]}$$

As described above, the decoding system according to the current embodiment of the present invention can estimate OPD using parameters transmitted from the encoding system although OPD is not transmitted from the encoding system so as to increase the number of parameters used for up-mixing and improve the quality of the up-mixed signal.

The inverse transformation unit 56 inversely transforms the signal up-mixed by the up-mixing unit 55 into the time domain.

Figure 6A:
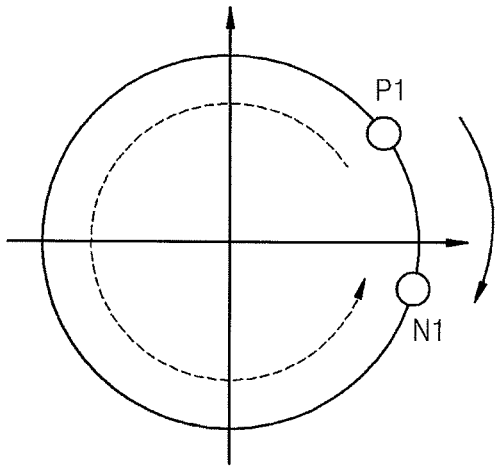
FIGS. 6A and 6B illustrate a phase interpolating operation of an OPD estimator included in the multi-channel signal decoding system illustrated in FIG. 5.
Figure 6B:
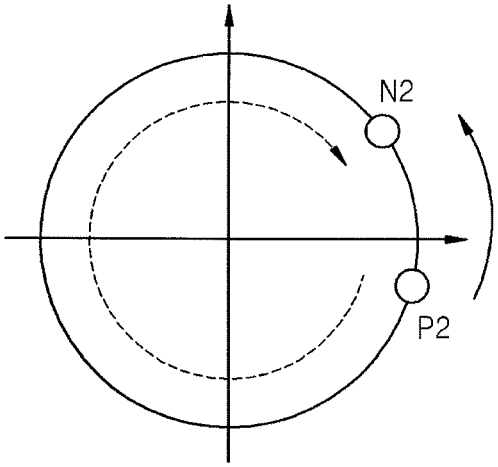

FIGS. 6A and 6B illustrate a phase interpolating operation of the decoding system illustrated in FIG. 5. The phase interpolating operation of the decoding system will now be explained with reference to FIGS. 5, 6A and 6B.

When an encoded multi-channel signal is decoded, the phase of the decoded signal is interpolated in order to prevent the signal from abruptly varying with time. For example, when there are four time slots between a current time slot and a previous time slot, and when the phase of a signal is 60° in the current time slot, and the phase of the signal is 10° in the previous time slot, the phase of the signal in the four time slots between the current time slot and the previous time slot can be estimated as 20°, 30°, 40° and 50° through interpolation of the signal in the current time slot and in the previous time slot. In FIG. 6A, P1 denotes the phase of a signal in the previous time slot and N1 denotes the phase of the signal in the current time slot.

According to a conventional signal phase interpolating method, the phase P1 is subtracted from the phase N1 and the subtraction result is divided by the number of time slots existing between the current time slot and the previous time slot. For example, when N1 is 350°, P1 is 25° and the number of time slots existing between the current time slot and the previous time slot is 4, phase interpolation is performed in a direction indicated by a dotted arrow illustrated in FIG. 6A to estimate the phase in the four time slots between the current time slot and the previous time slot as 90°, 155°, 220° and 285°.

In the phase interpolating method according to the current embodiment of the present invention, the phase interpolation direction can be changed when the absolute value of a difference between P1 and N1 is greater than 180°. In the current embodiment of the present invention, the absolute value of the difference between P1 and N1 is 320°, which is greater than 180°. In this case, the phase interpolation direction is changed to a direction indicated by a solid-line arrow illustrated in FIG. 6A, and thus the phase of the signal in the four time slots between the current time slot and the previous time slot can be estimated as 18°, 11°, 4° and 357° (that is, −3°).

In FIG. 6B, P2 denotes the phase of a signal in the previous time slot and N2 is the phase of a signal in the current time slot.

As described above, the conventional phase interpolating method subtracts P2 from N2 and divides the subtraction result by the number of time slots existing between the current time stop and the previous time slot. For example, when N2 is 25°, P2 is 350°, and the number of time slots existing between the current time slot and the previous time slot is 4, phase interpolation is performed along a direction indicated by a dotted arrow illustrated in FIG. 6B, and thus the phase in the four time slots between the current time slot and the previous time slot can be estimated as 285°, 220°, 155° and 90°.

In the phase interpolating method according to the current embodiment of the present invention, the phase interpolation direction can be changed when the absolute value of a difference between P2 and N2 is greater than 180°. In the current embodiment of the present invention, the absolute value of the difference between P2 and N2 is 320°, which is greater than 180°. In this case, the phase interpolation direction is changed to a direction indicated by a solid-line arrow illustrated in FIG. 6B, and thus the phase of the signal in the four time slots between the current time slot and the previous time slot can be estimated as 357° (that is, −3°), 4°, 11° and 18°.

As described above, the phase interpolating method according to the current embodiment of the present invention changes the phase interpolation direction when the absolute value of a difference between signal phases in two arbitrary time slots is greater than 180°, and thus a phase difference between interpolated values can be reduced to gradually vary the signal with time.

Figure 7:
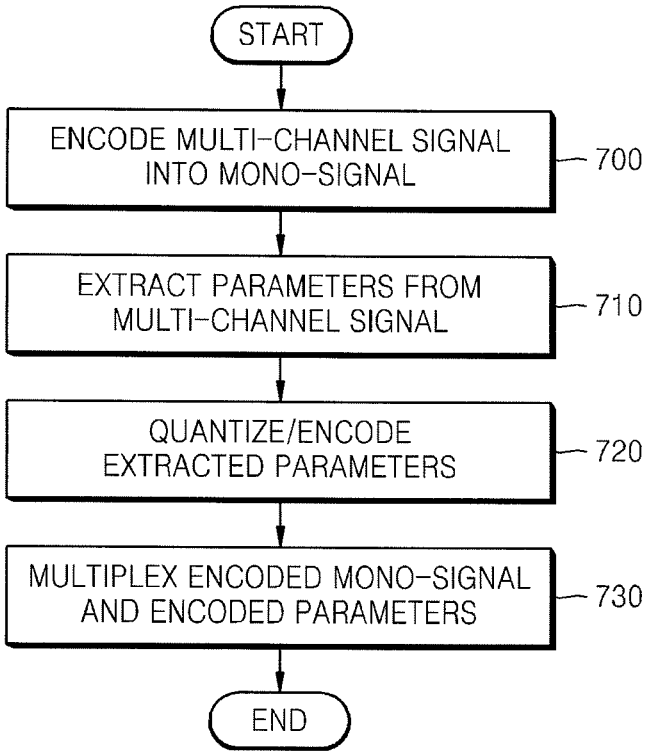
FIG. 7 is a flow chart of a multi-channel signal encoding method according to an embodiment of the present invention.

FIG. 7 is a flow chart of a multi-channel signal encoding method according to an embodiment of the present invention.

Referring to FIG. 7, the multi-channel signal encoding method includes operations sequentially performed in the multi-channel signal encoding system illustrated in FIG. 1, and thus the description of the multi-channel encoding system illustrated in FIG. 1 is applied to the multi-channel encoding method.

Referring to FIGS. 1 and 7, the down-mixing unit 12 down-mixes a multi-channel signal to a mono-signal and the mono-signal encoding unit 13 encodes the down-mixed mono-signal in operation 700.

The parameter extraction unit 14 extracts parameters that represent characteristic relations between channels of the multi-channel signal from the multi-channel signal in operation 710. The extracted parameters can include ICC, IPD and OPD.

The parameter encoding unit 15 encodes some of the extracted parameters other than a parameter that can be estimated from the some of the extracted parameters in operation 720. Specifically, the parameter encoding unit 15 quantizes some of the extracted parameters and arithmetic-encodes the quantization result based on the context of the quantization result.

The multiplexing unit 16 multiplexes the encoded mono-signal and the encoded parameters in operation 730.

Figure 8:
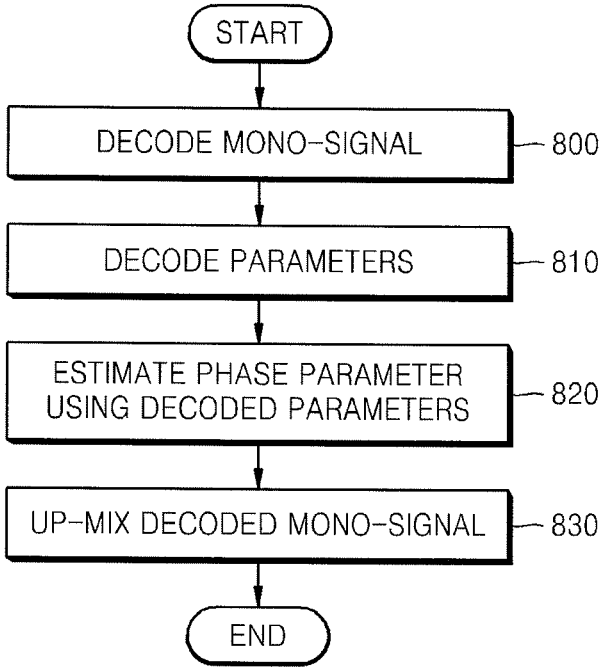
FIG. 8 is a flow chart of a multi-channel signal decoding method according to an embodiment of the present invention.

FIG. 8 is a flow chart of a multi-channel signal decoding method according to an embodiment of the present invention.

Referring to FIG. 8, the multi-channel signal decoding method includes operations sequentially performed in the multi-channel signal decoding system illustrated in FIG. 5, and thus the description of the multi-channel decoding system illustrated in FIG. 5 is applied to the multi-channel decoding method.

Referring to FIGS. 5 and 8, the mono-signal decoding unit 52 decodes a mono-signal representative of a multi-channel signal in operation 800. The parameter decoding unit 53 decodes parameters that represent characteristic relations between channels of the multi-channel signal in operation 810.

The OPD estimation unit 54 estimates an additional parameter by using the decoded parameters in operation 820. The additional parameter can be a phase parameter that represents a phase difference between the decoded mono-signal and the multi-channel signal. The OPD estimation unit 54 can multiply intermediate variables generated from IID of the multi-channel signal by the decoded mono-signal to generate first and second signals, generate a third signal from IPD of the multi-channel signal and the first and second signals, and estimate the phase parameter from the first, second and third signals.

The up-mixing unit 55 up-mixes the decoded mono-signal by using the decoded parameters and the estimated parameter to decode the multi-channel signal in operation 830.

In addition to the above described embodiments, embodiments of the present invention can also be implemented through computer readable code/instructions in/on a medium, e.g., a computer readable medium, to control at least one processing element to implement any above described embodiment. The medium can correspond to any medium/media permitting the storing and/or transmission of the computer readable code.

The computer readable code can be recorded/transferred on a medium in a variety of ways, with examples of the medium including recording media, such as magnetic storage media (e.g., ROM, floppy disks, hard disks, etc.) and optical recording media (e.g., CD-ROMs, or DVDs), and transmission media such as carrier waves, as well as through the Internet, for example. Thus, the medium may further be a signal, such as a resultant signal or bitstream, according to embodiments of the present invention. The media may also be a distributed network, so that the computer readable code is stored/transferred and executed in a distributed fashion. Still further, as only an example, the processing element could include a processor or a computer processor, and processing elements may be distributed and/or included in a single device.

While aspects of the present invention has been particularly shown and described with reference to differing embodiments thereof, it should be understood that these exemplary embodiments should be considered in a descriptive sense only and not for purposes of limitation. Any narrowing or broadening of functionality or capability of an aspect in one embodiment should not considered as a respective broadening or narrowing of similar features in a different embodiment, i.e., descriptions of features or aspects within each embodiment should typically be considered as available for other similar features or aspects in the remaining embodiments.

Thus, although a few embodiments have been shown and described, it would be appreciated by those skilled in the art that changes may be made in these embodiments without departing from the principles and spirit of the invention, the scope of which is defined in the claims and their equivalents.

What is claimed is:

1. A method of decoding a multi-channel signal from a down-mixed mono signal, the method comprising:

decoding information on a domain in which the down-mixed mono signal representative of the multi-channel signal has been encoded;

decoding the down-mixed mono signal in a frequency domain or a domain different from the frequency domain according to the decoded information;

decoding parameters that represent characteristic relations between channels of the multi-channel signal; and up-mixing the decoded down-mixed mono signal by using the decoded parameters so as to decode the multi-channel signal.

2. The method of claim 1, further comprising estimating an additional parameter by using the decoded parameters, and wherein the decoding of the multi-channel signal comprises up-mixing the decoded down-mixed mono signal by using the decoded parameters and the estimated parameter so as to decode the multi-channel signal.

3. The method of claim 2, wherein the decoded parameters are parameters that represent an inter-channel energy difference of the multi-channel signal and an inter-channel phase difference of the multi-channel signal, and the estimated parameter is a phase parameter that represents a phase difference between the decoded down-mixed mono signal and the multi-channel signal.

4. The method of claim 2, wherein the estimating of the additional parameter comprises:

multiplying intermediate variables generated from the inter-channel energy difference of the multi-channel signal by the decoded down-mixed mono signal to generate a first signal and a second signal;

generating a third signal from the inter-channel phase difference of the multi-channel signal and the first and second signals; and estimating the phase parameter from the first, second and third signals.

* * * * *